US006724357B2

(12) United States Patent
Kim et al.

(10) Patent No.: US 6,724,357 B2
(45) Date of Patent: Apr. 20, 2004

(54) APPARATUS AND METHOD FOR DRIVING SURFACE DISCHARGE PLASMA DISPLAY PANEL

(75) Inventors: Bong Chool Kim, Icheon-si (KR); Gyun Chae, Kunpo-si (KR)

(73) Assignee: UPD Corporation, Kyunggi-do (KR)

( * ) Notice: Subject to any disclaimer, the term of this patent is extended or adjusted under 35 U.S.C. 154(b) by 267 days.

(21) Appl. No.: 10/042,796

(22) Filed: Jan. 9, 2002

(65) Prior Publication Data

US 2002/0093470 A1 Jul. 18, 2002

(30) Foreign Application Priority Data

Jan. 12, 2001 (KR) ..... 2001-1799

(51) Int. Cl.[7] ..... G09G 3/28
(52) U.S. Cl. ..... 345/60; 345/66
(58) Field of Search ..... 345/60, 62, 63, 345/66; 315/169.1, 169.2, 169.3

(56) References Cited

U.S. PATENT DOCUMENTS 6,466,186 B1 * 10/2002 Shimizu et al. ..... 345/60
6,512,501 B1 * 1/2003 Nagaoka et al. ..... 345/66
6,608,609 B1 * 8/2003 Setoguchi et al. ..... 345/60

* cited by examiner

*Primary Examiner*—Amare Mengistu
(74) *Attorney, Agent, or Firm*—Lilling & Lilling P.C.

(57) ABSTRACT

There is provided an apparatus and a method for driving a surface discharge PDP in which a driving voltage supply frame for displaying an image is constructed of N sub-fields, and each sub-field is composed of an erasing period, an addressing period and a sustaining period, the sustaining period alternately providing a predetermined sustaining pulse to first and second electrodes constructing the display panel. The method comprises: a sustaining pulse counting step for counting the number of sustaining pulses by sub-fields, which are generated in the first electrode to which the final sustaining pulse of the sub-fields is supplied during the sustaining period of each sub-fields; and an erasing pulse supplying step for providing an erasing pulse having a slope to the second electrode on the basis of erasing pulse slope information corresponding to information about the number of the sustaining pulses counted in the sustaining pulse counting step, the slope of the erasing pulse corresponding to the erasing pulse slope information. Therefore, the slope of the erasing pulse is controlled to correspond to the quantity of remaining charges caused by supply of the previous sustaining pulse, to thereby improve picture quality of a black picture according to the high voltage and reduce the number of times of providing the high voltage writing pulse, realizing a plasma display panel with lower consumption power.

12 Claims, 8 Drawing Sheets

<PRIOR ART>

<PRIOR ART>

<PRIOR ART>

<PRIOR ART>

APPARATUS AND METHOD FOR DRIVING SURFACE DISCHARGE PLASMA DISPLAY PANEL

BACKGROUND OF THE INVENTION

1. Field of the Invention

The present invention generally relates to a surface discharge plasma display panel (PDP) and, more particularly, to an apparatus and method for driving a surface discharge PDP which control the slope of an erasing pulse to perform the initialization operation in sub-field periods of driving frames.

2. Description of the Related Art

Generally, a surface discharge plasma display panel (referred to as 'display panel' hereinafter) is a light emitting device which excites a fluorescent material placed inside discharge cells thereof, to thereby display images. It is compact, manufactured through simple fabrication processes and easily realized in a large screen so that it is widely used as a bulletin board of a stock exchange, a display for video conferencing and a wide-screen wall-hanged TV.

FIG. 1 roughly illustrates a general circuit for driving the surface discharge PDP. In FIG. 1, reference numeral 10 represents a color three-electrode surface discharge PDP with resolution LxK constructed in a manner that first L sustain electrodes $X_1$~$X_L$ and second L sustain electrodes $Y_1$~$Y_L$ are alternately arranged in parallel with each other, K address electrodes $A_1$~$A_K$ intersect the first and second sustain electrodes $X_1$~$X_L$ and $Y_1$~$Y_L$, having predetermined spaces therebetween, and cells S are formed at intersections where the first and second L sustain electrodes $X_1$~$X_L$ and $Y_1$~$Y_L$ intersect the K address electrodes $A_1$~$A_K$, to construct the entire screen of LxK R (red), G (green) and B (blue) cells in a matrix form. Here, the first L sustain electrodes $X_1$~$X_L$ are connected in parallel by a first common sustain electrode.

Reference number 20 in FIG. 1 denotes an X-electrode driver connected to the first sustain electrodes $X_1$~$X_L$ of the panel 10 to provide a driving pulse to them, and 30 represents an Y-electrode driver connected to the second sustain electrodes $Y_1$~$Y_L$, of the panel 10 to supply a driving pulse to them. In addition, reference numeral 40 represents an address driver connected to the address electrodes $A_1$~$A_K$ of the panel 10 to selectively apply a driving pulse to them based on a digital video signal corresponding to each cell S. Reference numeral 50 denotes a system controller which digitalizes an analog video signal IMAGE supplied from the outside to output a digital video signal, and provides various control signals to the X-electrode driver 20, Y electrode driver 30 and address driver on the basis of the digital video signal and various external signals (clock (CLK), horizontal synchronous signal (HS) and vertical synchronous signal (VS)).

FIG. 2 is a cross-sectional view of the cell S in FIG. 1. Referring to FIG. 2, an upper glass 11 and a lower glass 14 placed opposite to the upper glass 11 having a predetermined distance therebetween are combined with each other to construct a predetermined discharge space, that is, the discharge cell. The upper glass 11 is constructed in a manner that a first sustain electrode X and a second sustain electrode Y are formed thereon in parallel with each other, a dielectric layer 12 that restricts discharge current when discharge occurs and facilitates generation of wall charges is formed on the first and second sustain electrodes X and Y, and a MgO protection layer 13 for protecting the first and second sustain electrodes X and Y and the dielectric layer 12 from sputtering during discharge is formed on the dielectric layer 12. The lower glass 14 is constructed in such a manner that an address electrode A is formed on the plane opposite to the upper glass 11, first and second barriers 15*a* and 15*b* for preventing color mixture between cells and securing the discharge space are formed at both sides of the address electrode A in parallel therewith, and a fluorescent material 16 is coated on the address electrode A and parts of the first and second barriers.

The basic operation of the cell constructed as above is explained below with reference to FIGS. 3 and 4.

In the display panel, generally, the span of time for displaying one image is divided into a plurality of frames $F_1$~$F_n$ as shown in FIG. 3(A), each frame F being split into a plurality of sub-fields $SF_1$~$SF_M$ as shown in FIG. 3(B). In case of realization of 256 gray scales, for instance, one frame F is constructed of eight sub-fields $SF_1$~$SF_8$ to provide signals of the display panel. Each sub-field SF includes an initialization period, a data addressing period and a sustaining period, as shown in FIG. 3(C), to be provided with a predetermined signal.

That is, the sub-field SF applies a voltage with a predetermined level, 70V, for example, to the address electrode A first, and supplies the high voltage writing pulse of 400V, for example, to the first sustain electrode X during a period (a), as shown in FIG. 4. Here, cells S which were written or not written in the previous sub-field perform discharge according to the high voltage. At this time, excessive wall charges in the cells S formed by the high voltage generate self-erase discharge due to inner wall charges after falling of a writing pulse. Accordingly, negative wall charges are created in the first sustain electrode X and positive wall charges are formed in the second sustain electrode Y.

Subsequently, a predetermined erasing pulse is applied to the second sustain electrode Y while voltages of the address electrode A and the first sustain electrode X being set to a predetermined level, 0V, during periods (b) and (c). This erases the wall charges formed in the second sustain electrode Y during the period (a). That is, a small amount of negative wall charges formed in the first sustain electrode X and a small quantity of positive wall charges created in the second sustain electrode Y are neutralized in the discharge space according to the erasing pulse applied to the second sustain electrode Y, to thereby remove the wall charges remaining in the cell S.

Through the aforementioned initialization operation, electron and wall charge components formed in the first and second sustain electrodes X and Y of the cell S are cleared, and then 70V, for example, is applied to the address electrode A, 50V, for example, is applied to the first sustain electrode X, and a reverse voltage (negative voltage) with a predetermined level is applied to the second sustain electrode Y, to perform data addressing operation through the address electrode A. Here, discharge for data addressing occurs in the address electrode, first and second sustain electrodes X and Y. At this time, discharge of the first and second sustain electrodes X and Y is facilitated according to charged particles in the discharge space so that generation of secondary discharge forms negative wall charges in the first sustain electrode X and positive wall charges in the second sustain electrode Y, during a period (d).

Subsequently, the voltages of the address electrode A, first and second sustain electrodes X and Y are set to 0V, for instance, at a point of time when the data addressing period of the sub-field SF is finished, and a predetermined positive voltage is applied to the second sustain electrode Y, to generate discharge caused by the positive wall charges in the cell S, created in the second sustain electrode Y during the data addressing period (d) and the voltage applied from the outside in the first electrode X during a period (e). That is, a predetermined sustaining pulse is applied to the second sustain electrode Y.

After supply of the sustaining pulse to the second sustain electrode Y, as described above, a predetermined positive voltage is provided to the first sustain electrode X to discharge the positive wall charges formed in the first sustain electrode X to the second sustain electrode Y. In other words, a predetermined sustaining pulse is applied to the first sustain electrode X during a period (f).

Thereafter, the operations (e) and (f) are alternately performed during the sustaining period of the sub-field SF to finish one sub-field operation. The operation of the sub-field, as described above, is repeated.

However, the initialization operation, constructed in a manner that the high voltage of +400V, that is, a writing pulse, is applied to the first sustain electrode X in the sub field SF and then a predetermined erasing pulse is provided to the second sustain electrode Y to erase positive charges formed in the first or second sustain electrode X or Y, that are caused by application of the last sustaining pulse to the sustain electrode during the last sustaining period of the previous sub-field, results in supply of the high voltage N×M times in case where N frames construct one picture and one frame F consists of M sub-fields SF.

Furthermore, the multi-time supply of the high voltage decreases reliability of the circuit for driving the PDP and increases power consumption.

Moreover, the repeated supply of the high voltage shows picture characteristic having brightness of 4 cd approximately when a black picture is expressed, deteriorating the contrast of the display panel.

SUMMARY OF THE INVENTION

It is, therefore, an object of the present invention to provide an apparatus and a method for driving a PDP, which adjust the slope of an erasing pulse to erase charges remaining in the previous sub-field during the initialization period of sub-fields constructing one frame and provide a high voltage writing pulse in at least one frame, to thereby minimize consumption power due to the writing pulse and deterioration of the contrast picture characteristic.

To accomplish the object of the present invention, there is provided an apparatus for driving a surface discharge plasma display panel including a panel constructed of M first and second electrodes and K address electrodes, and a system controller for controlling driving power supplied to the first and second electrodes and the address electrodes, the plasma display panel being constructed in a manner that a frame for displaying an image is divided into N sub-fields, each sub-field is composed of an erasing period, an addressing period and a sustaining period, and the second electrodes have an erasing pulse generating means providing an erasing pulse during the erasing period, wherein the system controller comprises a counter for counting the number of sustaining pulses applied to the first electrode by sub-fields, a data memory for storing erasing pulse slope information corresponding to the number of the sustaining pulses, and a signal processor for reading corresponding slope information from the data memory and transmitting read slope information to the erasing pulse generating means based on the information about the number of sustaining pulses supplied from the counter, and the pulse generating means generates an erasing pulse having a slope based on the slope information supplied from the signal processor, the slope corresponding to the slope information.

To accomplish the object of the present invention, there is also provided a method for driving a surface discharge plasma display panel in which a driving voltage supply frame for displaying an image is constructed of N sub-fields, and each sub-field is composed of an erasing period, an addressing period and a sustaining period, the sustaining period alternately providing a predetermined sustaining pulse to first and second electrodes constructing the display panel, the method comprising: a sustaining pulse counting step for counting the number of sustaining pulses by sub-fields, which are generated in the first electrode to which the final sustaining pulse of the sub-fields is supplied during the sustaining period of each sub-fields; and an erasing pulse supplying step for providing an erasing pulse having a slope to the second electrode on the basis of erasing pulse slope information corresponding to information about the number of the sustaining pulses counted in the sustaining pulse counting step, the slope of the erasing pulse corresponding to the erasing pulse slope information.

Furthermore, the apparatus and method for driving a surface discharge PDP according to the present invention apply a high voltage writing pulse to the first sustain electrode when a sub-field period corresponding to at least one frame has been finished.

According to the present invention, the slope of the erasing pulse is controlled to correspond to remaining charges generated by supplying the sustaining pulse, to improve the picture quality of black pictures due to the high voltage and reduce the number of times of providing the high voltage writing pulse, resulting in the realization of a PDP with low consumption power.

BRIEF DESCRIPTION OF THE DRAWINGS

Further objects and advantages of the invention can be more fully understood from the following detailed description taken in conjunction with the accompanying drawings, in which.

DETAILED DESCRIPTION OF THE PREFERRED EMBODIMENT

The present invention will now be described in connection with preferred embodiments with reference to the accompanying drawings.

Figure 1:
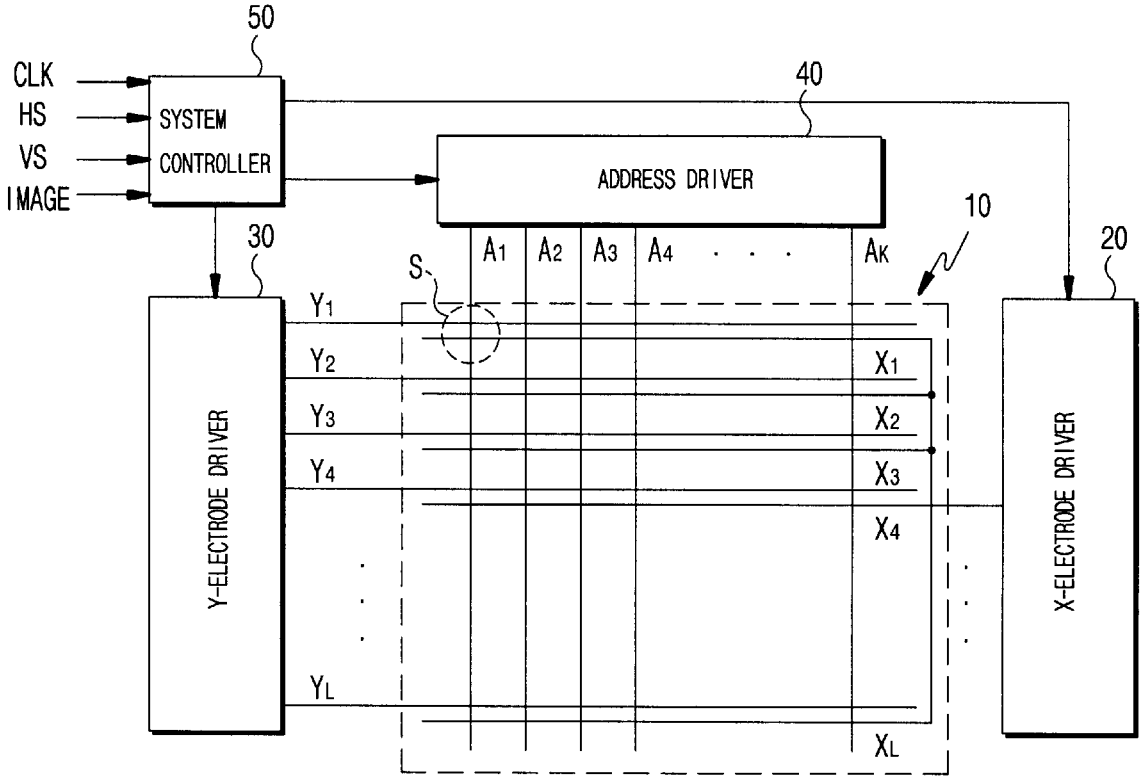
FIG. 1 roughly illustrates a general circuit for driving a coplanar PDP.
Figure 2:
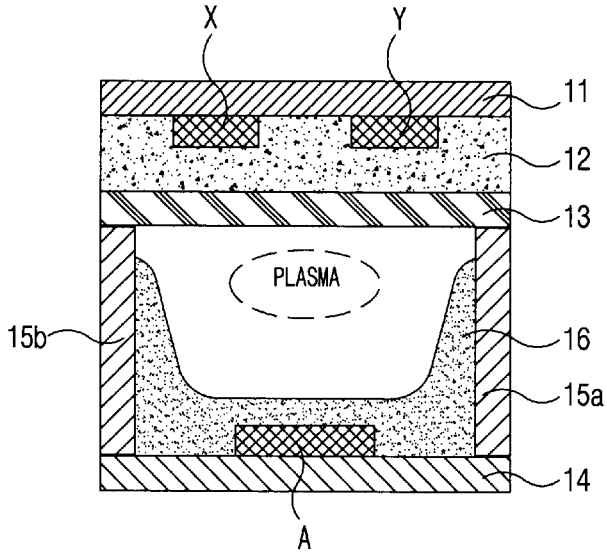
FIG. 2 is a cross-section view of the cell S shown in FIG. 1.
Figure 3:
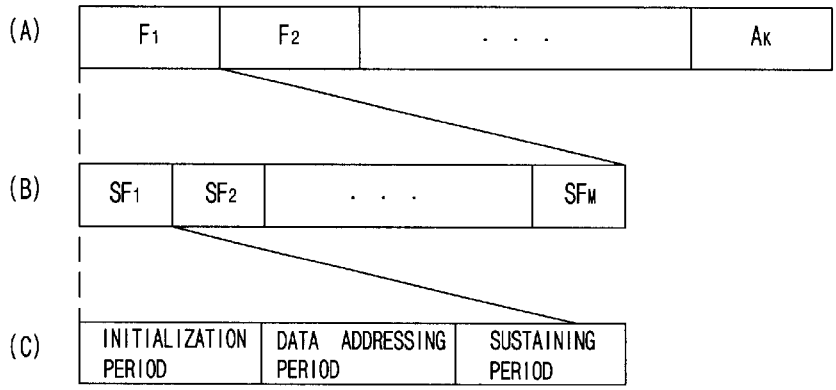
FIGS. 3 and 4 are diagrams for explaining the operation of the driving circuit shown in FIG. 1.
Figure 4:
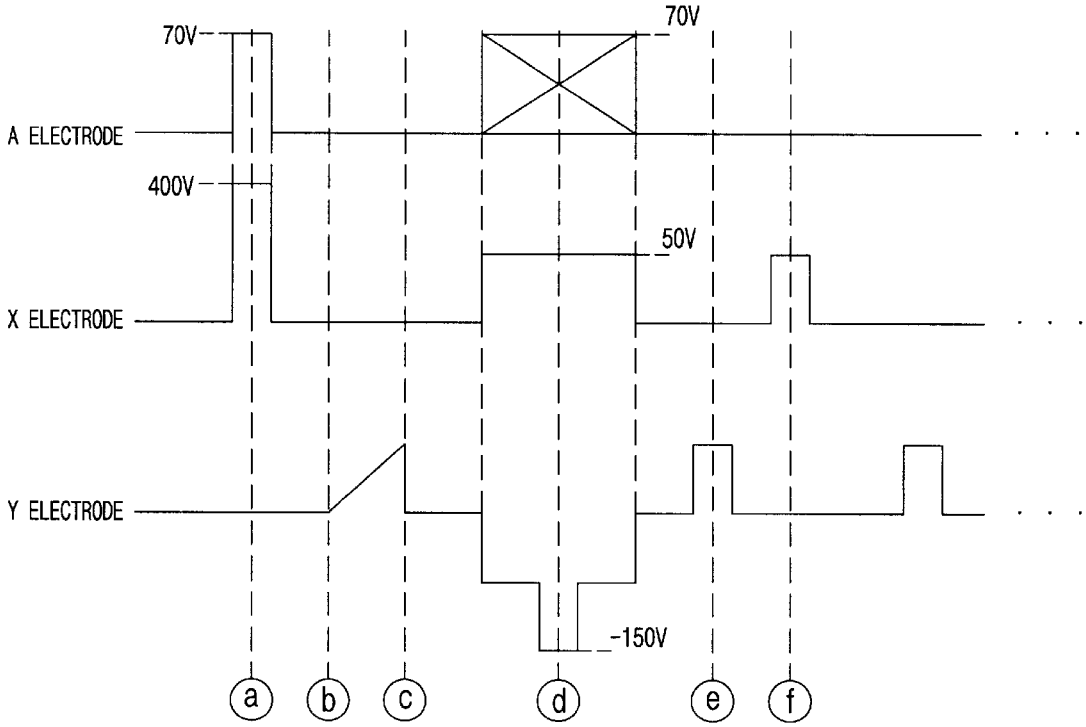
Figure 5:
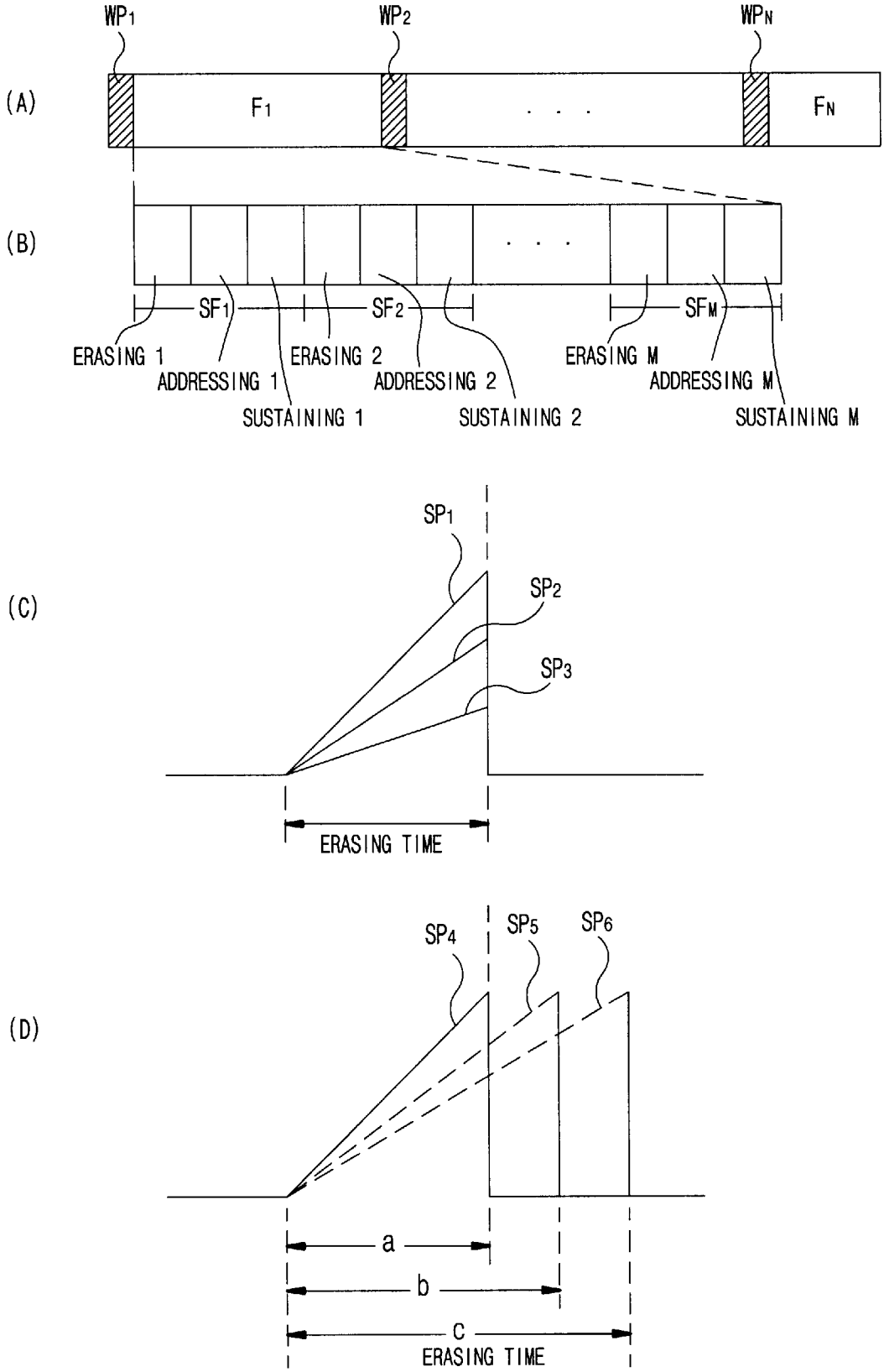
FIG. 5 is a diagram for explaining a method for driving a surface discharge PDP according to the present invention.

FIG. 5 is a diagram for roughly explaining a method for driving a PDP according to the present invention. Referring to FIG. 5, the PDP according to the invention is constructed in a manner that a high voltage writing pulse WP is applied to each of at least one frame F, as shown in FIG. 5(A), when a predetermined driving power is supplied to the panel 10. The frame F consists of a plurality of sub-fields SF repeating erasing, addressing and sustaining operations, as shown in FIG. 5(B). The erasing operation of each sub-field SF is performed in a manner that an erasing pulse in a predetermined lamp wave is applied to the second sustain electrode Y as in the periods (b) and (c) shown in FIG. 4. Here, the erasing pulse is not necessarily needed to be applied to the second sustain electrode Y but it is supplied to a sustain electrode corresponding to an electrode to which the last sustaining pulse of a sub-field SF is applied, set when the PDP is designed. In the case that the electrode to which the final sustaining pulse of the sub-field SF is set to be the second sustain electrode Y, for example, the erasing pulse according to the present invention is provided to the first sustain electrode X. Only the case where the erasing pulse is applied to the second sustain electrode Y is explained in the following embodiments of the present invention.

The erasing pulse provided by each sub-field SF has a ramp waveform having a slope corresponding to the number of sustain electrodes created in the previous sub-field SF. Specifically, the number of the sustaining pulses generated in the previous sub-field SF, for instance, the number of the sustaining pulses applied by the previous sub-field to the first sustain electrode X when the erasing pulse is applied to the second sustain electrode Y, is counted to output the ramp wave. Here, the slope of the ramp wave becomes gentle ($SP_3$ in FIG. 5(C)) or an erasing time of the slope becomes long ($SP_6$ in FIG. 5(C)) as the number of the sustaining pulses increases.

A predetermined amount of charges remain in the first sustain electrode X in proportion to the number of the sustaining pulses provided by the previous sub-field SF to the first sustain electrode X. Thus, as the number of sustain electrodes increases, a pulse with gentler slope and smaller voltage or a pulse having a fixed voltage level and longer driving time is outputted. FIGS. 5(C) and (D) illustrate erasing pulses in a ramp waveform which have difference slopes. In FIGS. 5(C) and (D), the range of the number of the sustaining pulses is divided into three parts, in which the erasing pulses $SP_3$ and $SP_6$ have slopes of the first range corresponding to the maximum number of the sustaining pulses, slopes $SP_2$ and $SP_5$ of the second range corresponding to the medium number of the sustaining pulses and slopes $SP_1$, and $SP_4$ of the third range corresponding to the minimum number of the sustaining pulses.

Figure 6:
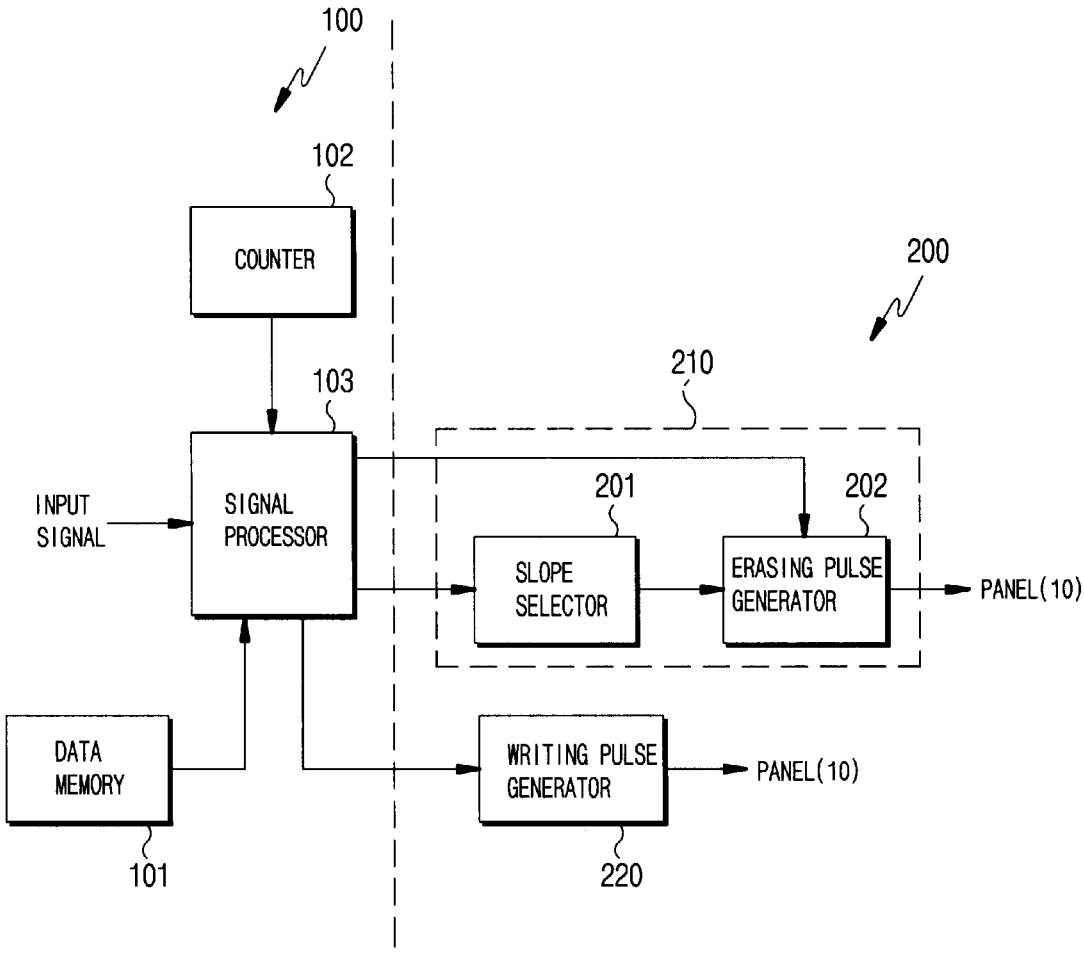
FIG. 6 is a block diagram showing an apparatus for driving the surface discharge PDP according to the present invention.

FIG. 6 is a block diagram of the PDP driven as described in FIG. 5, illustrating principal parts of the PDP. In FIG. 6, reference numeral 100 represents a system controller which includes: a data memory 101 for storing predetermined slope information according to the number of sustaining pulses; a counter 102 for counting the number of sub-fields and the number of sustaining pulses provided by one sub-field based on a predetermined control signal; and a signal processor 103 for reading slope information corresponding to information on the counted number of the sustaining pulses provided by the counter 102 from the data memory 101 to transmit corresponding slope information and a signal for controlling generation of an erasing pulse to an erasing pulse generating means 210, which will be explained below, and sending a predetermined control signal to a writing pulse generator 220 based on the information on the number of sub-fields provided by the counter 102.

The signal processor 103 is constructed so as to transmit a predetermined control signal to the writing pulse generator 220 when sub-fields corresponding to one frame have been provided. In addition, the signal processor 103 may be configured in such a manner that it sends the control signal to the writing pulse generator 220 and then transmits a predetermined control signal to the writing pulse generator 220 when sub-fields corresponding to at least one frame are supplied from the counter 102.

Reference numeral 200 in FIG. 6 represents principal parts of the Y-electrode driver. The Y-electrode driver includes the erasing pulse generating means 210 consisting of a slope selector 201 and an erasing pulse generator 202, and the writing pulse generator 220 which generates a high voltage, 400V, for example, for a predetermined period of time on the basis of the control signal applied from the signal processor 103. The slope selector 201 transmits a predetermined control signal based on the slope information applied by the signal processor 103. The erasing pulse generator 202 generates an erasing pulse with a slope corresponding to a slope control signal applied from the slope selector 201, on the basis of a driving signal supplied from the signal processor 103.

Figure 7:
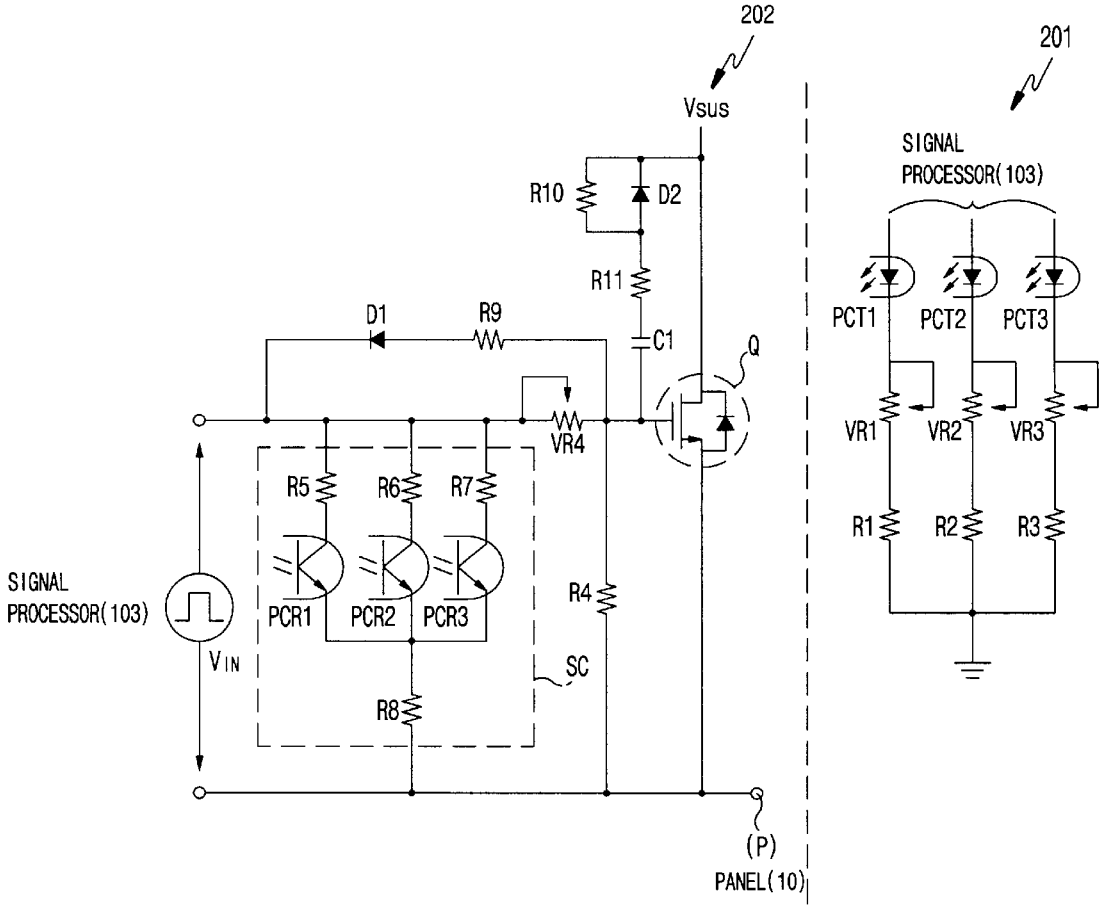
FIG. 7 is a detailed circuit diagram of the erasing pulse generating means 210 shown in FIG. 6.

FIG. 7 illustrates an example of the circuit configuration of the erasing pulse generating means 210 shown in FIG. 6 in detail. Referring to FIG. 7, the slope selector 201 is constructed in a manner that a light-emitting device part PCT, a variable resistor part VR and a resistor part R are serially connected between the signal processor 103 and ground. Preferably, the light-emitting device part has first, second and third light-emitting devices PCT1, PCT2 and PCT3, the variable resistor part has first, second and third variable resistors VR1, VR2 and VR3, and the resistor part has first, second and third resistors R1, R2 and R3.

The erasing pulse generator 202 is constructed in such a manner that the drain D of an FET Q is connected to a power supply Vsus, its source S is coupled to a driving voltage output port P connected to the panel 10, and its gate G is coupled to the signal processor 103. Here, a variable resistor VR4 is connected between the gate G of the FET Q and the signal processor 103. This variable resistor VR4 sets the initial slope value of the erasing pulse outputted to the driving voltage output port P connected to the source S of the FET Q.

In addition, a resistor R4 is connected between the gate G and source S of the FET Q, and a slope controlling circuit SC is connected in parallel with the resistor R4. Here, the slope controlling circuit SC is constructed in a manner that a resistor R5, a light-receiving device PCR1 and a resistor R8 are serially connected and light-receiving devices PCR2 and PCR3, respectively coupled to resistors R6 and R7, are connected in parallel with the resistor R5 and the light-receiving device PCR1. The number of light-receiving devices PCR1, PCR2 and PCR3 serially connected with the resistors R5, R6 and R7 corresponds to the number of the light-emitting devices PCT1, PCT2 and PCT3 of the slope selector 201. The light-emitting device group PCT constructing the slope selector 201 and the light-receiving device group PCR of the slope controlling circuit SC of the erasing pulse generator 202 are configured of photocouplers, corresponding to each other.

Accordingly, the erasing pulse generating means 210 sets the light-receiving devices PCR constructing the slope controlling circuit SC in ON or OFF state according to a slope control signal applied by the signal processor 201 to the slope selector, that is, according to ON/OFF control of the light-emitting devices PCT. Furthermore, the erasing pulse generating means 210 sets the slope of a capacitor charged between the gate G and source C of the FET Q according to the value of a resistor connected to the light-receiving device PCR in ON state in the slope controlling circuit SC.

Meantime, a resistor R9 and a reverse diode D1 are serially connected between the gate G of the FET Q and the signal processor 103 to perform a falling speed-up function for increasing the discharge speed of the capacitor between the gate G and source S of the FET Q at the falling time of a driving pulse applied from the signal processor 103. Moreover, a diode D2, a resistor R11 and a capacitor C1 are serially connected between the drain D and gate G of the FET Q, and a resistor R10 is connected in parallel with the diode D2. Here, the resistor R10 and diode D2 connected in parallel with each other prevent reverse current of the FET Q, and the resistor R11 and capacitor C1 set the charging time of a parasitic capacitor existing between the drain D and gate G of the FET Q. That is, the charging time of the capacitor between the drain D and gate G of the FET Q is determined to correspond to a time constant set by the values of the resistor R11 and capacitor C1.

The operation of the PDP constructed as above is explained below.

First of all, the signal processor 103 applies a control signal to the writing pulse generator 220 in at least one frame on the basis of information about the number of sub-fields supplied from the counter 102. In addition, the signal processor 103 reads corresponding slope information from the data memory 101 based on information about the number of sustaining pulses generated in the previous sub-field, provided by the counter 102, and applies a predetermined control signal to the slope selector 201 to correspond to the read slope information. Further, the signal processor supplies a predetermined driving pulse for generating an erasing pulse to the erasing pulse generator 202. In other words, the signal processor 103 sequentially turns on/off the plurality of photo-couplers of the erasing pulse generator 202 according to the slope information read from the data memory 101. Accordingly, the entire resistance of the slope controlling circuit SC constructing the erasing pulse generator 202 is varied to change the current of the capacitor between the gate G and source S of the FET Q, thereby setting the erasing pulse output characteristic of the driving voltage output port P connected to the source C of the FET Q.

Figure 8:
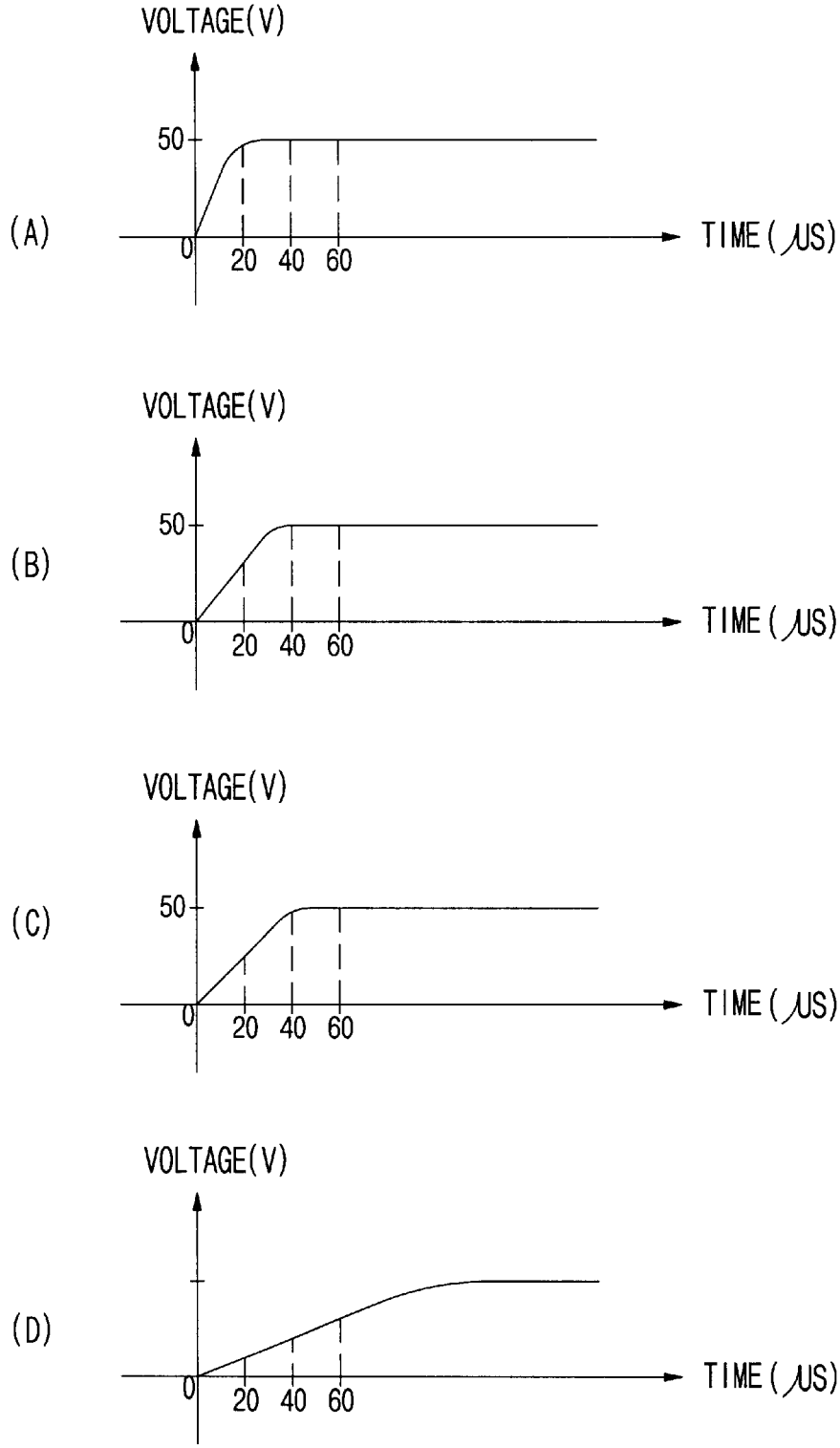
FIG. 8 illustrates the result of an experiment for explaining slope features according to the operation of the erasing pulse generating means 210 of FIG. 7.

FIG. 8 illustrates the output characteristic of the driving voltage output port P of the FET Q under the control of the slope selector 201. FIG. 8 shows output voltages according to the capacitor between the gate G and source S of the FET Q depending on the state of the light-receiving devices PCR1, PCR2 and PCR3 in case where the resistors R5, R6 and R7 connected with the light-receiving devices PCR1, PCR2 and PCR3 of the slope controlling circuit SC have the same value. FIG. 8(A) illustrates the case that all of the first, second and third light-receiving devices PCR1, PCR2 and PCR are in ON state, and FIG. 8(B) shows the case that only the first light-receiving device PCR1 is ON. In addition, FIG. 8(C) illustrates the case where the first and second light-receiving devices PCR1 and PCR2 are ON, and FIG. 8(D) shows the case that the first and third light-receiving devices PCR1 and PCR3 are ON. Here, the slope feature of the capacitor corresponds to the slope feature of the erasing pulse outputted to the driving voltage output port P.

As shown in FIG. 8, the light-receiving devices serially coupled to the gate G of the FET Q are connected with the plurality of resistors, and they are turned on or off according to a predetermined control signal provided by the signal processor 103, to adjust a current or voltage level applied to the gate G of the FET Q, thereby controlling the slope of the erasing pulse outputted to the driving voltage output port P of the FET Q. Accordingly, charges remaining in the first sustain electrode (X or second sustain electrode) in the previous sub-field can be easily erased with the erasing pulse with the slope corresponding to the quantity of the charges through the second sustain electrode (Y or first sustain electrode).

Figure 9:
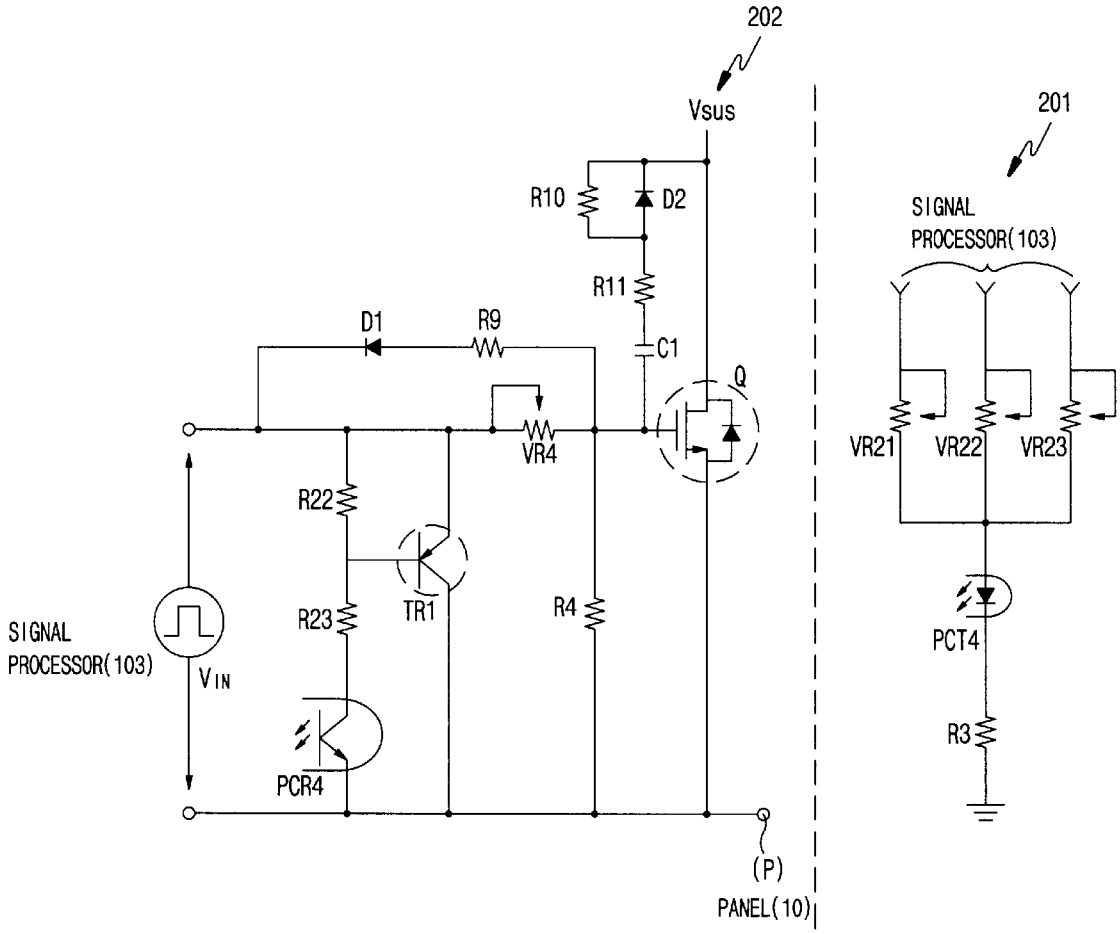
FIGS. 9 and 10 are detailed circuit diagrams of the erasing pulse generating means 210 according to another embodiments.

FIG. 9 is a circuit diagram showing another circuit configuration of the erasing pulse generating means 200 of FIG. 6. Parts similar to those in FIG. 6 are designated by like reference numerals and explanation for them is omitted. Referring to FIG. 9, the slope selector 201 of the erasing pulse generating means 200 is constructed in such a manner that one end of a light-emitting device PCT4 is connected to the ground through a resistor R3 and the other end is connected to a plurality of, for instance, first, second and third variable resistors VR5, VR6 and VR7 which are connected to the signal processor 103 so as to control the quantity of current flowing in the light-emitting device PCT4 to correspond to the first, second and third variable resistors VR5, VR6 and VR7 that operate according to a control signal applied from the signal processor 103.

Furthermore, the erasing pulse generator 202 is constructed in a manner that a current path between the collector C and emitter E of a PNP transistor TR1 is formed between the gate G and source S of an FET Q, and the base B of the PNP transistor TR1 is connected to the connection node of resistors R22 and R23 connected in parallel with the current path between the collector C and emitter E, the resistor R23 being serially connected with a light-receiving device PCR4. The light-receiving device PCR4 is a photo-coupler corresponding to the light-emitting device PCT4 of the slope selector 201. The level of current generated by the light-receiving device PCR4 is varied according to the quantity of emitted light corresponding to current provided by the light-emitting device PCT4. Accordingly, the quantity of current flowing toward the base B of the PNP transistor TR1 is adjusted to control the quantity of charging current between the gate G and source S of the FET Q, thereby controlling the slope of the erasing pulse outputted from the driving voltage output port P.

Figure 10:
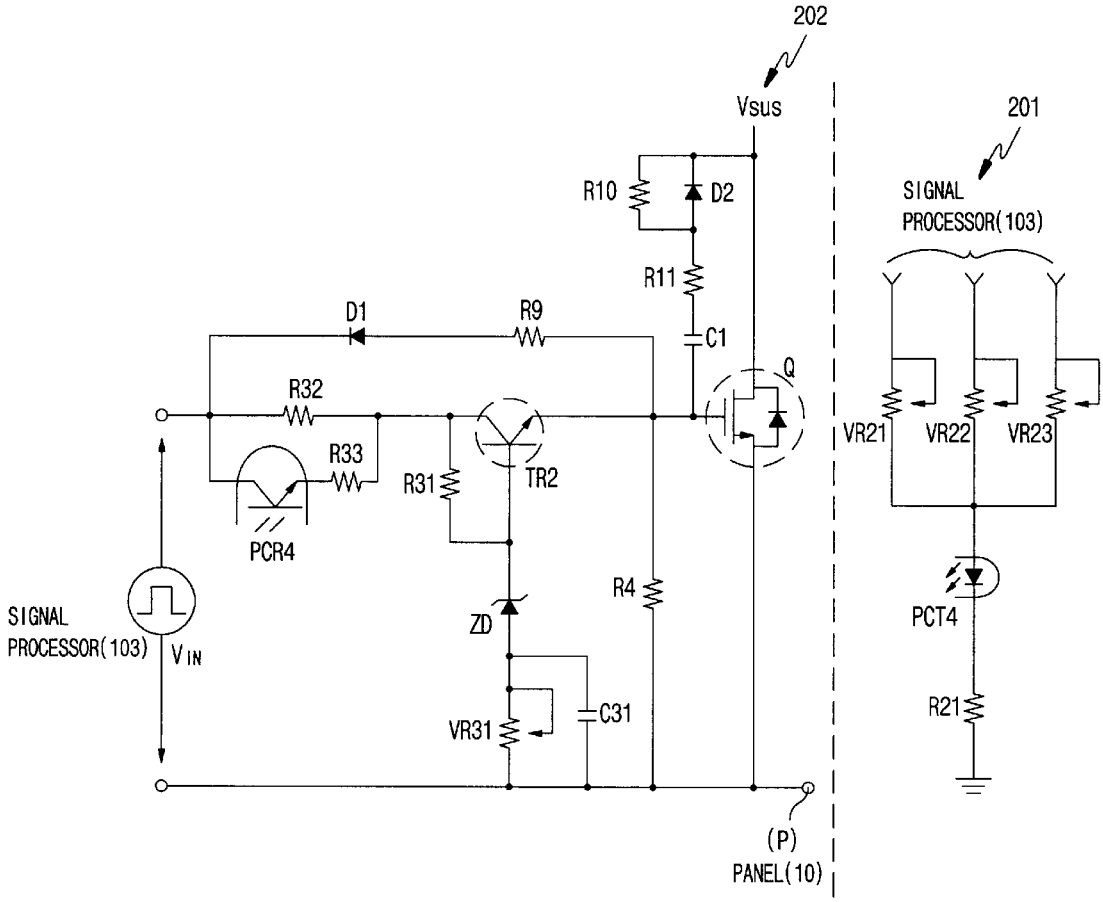

FIG. 10 is a circuit diagram showing another circuit configuration of the erasing pulse generating means 210 of FIG. 6. Parts similar to those in FIG. 6 are designated by like reference numerals and explanation for them is omitted.

Referring to FIG. 10, the erasing pulse generator 202 of the erasing pulse generating means 210 is constructed in such a manner that the collector C and emitter E of an NPN transistor TR2 are connected to the signal path between the gate G of an FET Q and the signal processor 103, and a zener diode ZD and a variable resistor VR31 are serially connected between the base B of the NPN transistor TR2 and the driving voltage output port P. In addition, a capacitor C31 is connected in parallel with the variable resistor VR31, and a resistor 31 is connected between the base B and collector C of the NPN transistor TR2. Furthermore, a resistor R32 is connected to the signal path between the collector C of the NPN transistor TR2 and the signal processor 103, the resistor R32 being connected in parallel with a light-receiving device PCR4 and a resistor R33.

In the aforementioned configuration, the current level of the light-receiving device PCR4 is adjusted to correspond to the level of current generated in the light-emitting device PCT4 of the slope selector 201 to regulate the current level of an input pulse of the gate of the FET Q, thereby controlling the slope of the erasing pulse outputted to the driving voltage output port P of the FET Q.

According to the present invention, in the plasma display panel in which a frame for expressing one image is constructed of a plurality of sub-fields to be driven and controlled, the sub-fields provide a predetermined erasing pulse, controlling the slope thereof, so that the slope correspond to the amount of charges finally being left, which are generated by the sustaining pulse provided by the previous sub-field. By doing so, the initialization operation of the sub-fields can be performed without carrying out the operation of providing the high voltage writing pulse.

Furthermore, the high voltage writing pulse is provided in at least one frame to prevent deterioration of picture quality of the plasma display panel due to probability of existence of charges which can occurs in multiple sub-fields through the control of the slope of the erasing pulse.

As described above, therefore, the slope of the erasing pulse is controlled to correspond to the quantity of remaining charges caused by supply of the previous sustaining pulse, to thereby improve picture quality of a black picture according to the high voltage and reduce the number of times of providing the high voltage writing pulse, realizing a plasma display panel with lower consumption power.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A method for driving a surface discharge plasma display panel in which a driving voltage supply frame for displaying an image is constructed of N sub-fields, and each sub-field is composed of an erasing period, an addressing period and a sustaining period, the sustaining period alternately providing a predetermined sustaining pulse to first and second electrodes constructing the display panel, the method comprising:

a sustaining pulse counting step for counting the number of sustaining pulses by sub-fields, which are generated in the first electrode to which the final sustaining pulse of the sub-fields is supplied during the sustaining period of each sub-fields; and an erasing pulse supplying step for providing an erasing pulse having a slope to the second electrode on the basis of erasing pulse slope information corresponding to information about the number of the sustaining pulses counted in the sustaining pulse counting step, the slope of the erasing pulse corresponding to the erasing pulse slope information.

2. The method as claimed in claim 1, wherein the slope of the erasing pulse provided in the erasing pulse supplying step becomes gentle as the number of the previous sustaining pulses increases.

3. The method as claimed in claim 1, further comprising a step of applying a high voltage writing pulse to the first electrode when a sub-field period corresponding to at least one frame has been finished.

4. An apparatus for driving a surface discharge plasma display panel including a panel constructed of M first and second electrodes and K address electrodes, and a system controller for controlling driving power supplied to the first and second electrodes and the address electrodes, the plasma display panel being constructed in a manner that a frame for displaying an image is divided into N sub-fields, each sub-field is composed of an erasing period, an addressing period and a sustaining period, and the second electrodes have an erasing pulse generating means providing an erasing pulse during the erasing period, wherein the system controller comprises a counter for counting the number of sustaining pulses applied to the first electrode by sub-fields, a data memory for storing erasing pulse slope information corresponding to the number of the sustaining pulses, and a signal processor for reading corresponding slope information from the data memory and transmitting read slope information to the erasing pulse generating means based on the information about the number of sustaining pulses supplied from the counter, and the pulse generating means generates an erasing pulse having a slope based on the slope information supplied from the signal processor, the slope corresponding to the slope information.

5. The apparatus as claimed in claim 4, wherein the slope of the slope information stored in the data memory becomes gentle as the number of the sustaining pulses supplied from the counter increases.

6. The apparatus as claimed in claim 4, wherein, with the slope information stored in the data memory, the span of time of sustaining the erasing pulse at a predetermined voltage level becomes longer as the number of the sustaining pulses supplied from the counter increases.

7. The apparatus as claimed in claim 4, wherein the pulse generating means comprises:

an FET whose drain is connected to power voltage, whose source is connected to a driving voltage output port coupled to the panel, and whose gate is connected to the signal processor;

a first resistor connected between the gate and source of the FET; and a slope selecting circuit configured of at least one photo-coupler connected in parallel with the first resistor.

8. The apparatus as claimed in claim 7, wherein the signal processor selectively turns on/off the photo-coupler of the slope selecting circuit to correspond to the slope information.

9. The apparatus as claimed in claim 8, wherein the signal processor controls the level of current applied to the photo-coupler of the slope selecting circuit to correspond to the slope information.

10. The apparatus as claimed in claim 9, wherein the slope selecting circuit is constructed in a manner that a PNP transistor is connected in parallel with a first resistor connected between the gate and source of the FET, the base of the PNP transistor is connected to the connection node of second and third resistors, and a light-receiving device is connected between the third resistor and the source of the FET, the light-receiving device corresponding to a light-emitting device constructing a first slope controlling circuit, the light-emitting device being connected in parallel with a plurality of variable resistors connected to the signal processor.

11. The apparatus as claimed in claim 4, wherein the pulse generating means comprises:

an FET whose drain is connected to power voltage, whose source is coupled to the driving voltage output port connected with the panel and whose gate is connected to the signal processor;

an NPN transistor connected to a signal path between the gate of the FET and the signal processor;

a light-receiving device connected to a signal path between the collector of the NPN transistor and the signal processor; and a light-emitting device connected to at least one variable resistor connected between the signal processor and ground to control the level of current generated in the light-receiving device.

12. The apparatus as claimed in claim 4, further comprising a writing pulse generating means for generating a high voltage writing pulse based on a predetermined control signal, wherein the signal processor of the system controller provides a predetermined writing pulse to the panel through the writing pulse generating means in at least one frame.

* * * * *